US009129506B1

(12) United States Patent
Kusens

(10) Patent No.: US 9,129,506 B1
(45) Date of Patent: Sep. 8, 2015

(54) METHOD AND PROCESS FOR DETERMINING WHETHER AN INDIVIDUAL SUFFERS A FALL REQUIRING ASSISTANCE

(75) Inventor: Neil Kusens, Los Angeles, CA (US)

(73) Assignee: CERNER INNOVATION, INC. a Delaware Corporation, Kansas City, KS (US)

( * ) Notice: Subject to any disclaimer, the term of this patent is extended or adjusted under 35 U.S.C. 154(b) by 0 days.

(21) Appl. No.: 13/543,816

(22) Filed: Jul. 7, 2012

Related U.S. Application Data

(60) Provisional application No. 61/507,088, filed on Jul. 12, 2011.

(51) Int. Cl.
*G08B 23/00* (2006.01)
*G08B 21/04* (2006.01)

(52) U.S. Cl.
CPC ..... *G08B 21/0446* (2013.01)

(58) Field of Classification Search
USPC ..... 340/573.1, 573.4, 573.7, 540, 686.1, 340/539.1, 500; 702/188; 700/28, 32
See application file for complete search history.

(56) References Cited

U.S. PATENT DOCUMENTS

| | | | | |
|---|---|---|---|---|
| 5,448,221 | A | 9/1995 | Weller | |
| 6,160,478 | A * | 12/2000 | Jacobsen et al. | 340/539.12 |
| 6,614,349 | B1 | 9/2003 | Proctor et al. | |
| 2007/0085690 | A1 * | 4/2007 | Tran | 340/573.1 |
| 2007/0279219 | A1 | 12/2007 | Warriner | |
| 2008/0002860 | A1 * | 1/2008 | Super et al. | 382/114 |
| 2009/0278934 | A1 | 11/2009 | Ecker et al. | |
| 2009/0322513 | A1 * | 12/2009 | Hwang et al. | 340/539.12 |
| 2010/0176952 | A1 * | 7/2010 | Bajcsy et al. | 340/573.1 |
| 2010/0285771 | A1 | 11/2010 | Peabody | |
| 2011/0025493 | A1 * | 2/2011 | Papadopoulos et al. | 340/539.12 |
| 2011/0087079 | A1 * | 4/2011 | Aarts | 600/300 |

OTHER PUBLICATIONS

Pending U.S. Application by same inventor Neal Kusens, U.S. Appl. No. 14/084,588, filed Nov. 19, 2013, entitled "Method for Determining Whether an Individual Leaves a Prescribed Virtual Perimeter".
Pending U.S. Application by same inventor Neal Kusens, U.S. Appl. No. 14/575,850, filed Dec. 18, 2014, entitled "Method and Process for Determining Whether an Individual Suffers a Fall Requiring Assistance".
Pending U.S. Application by same inventor Neal Kusens, U.S. Appl. No. 14/599,498, filed Jan. 17, 2015, entitled "Method and System for Determining Whether an Individual Takes Appropriate Measures to Prevent the Spread of Healthcare Associated Infections".

(Continued)

*Primary Examiner* — Travis Hunnings
(74) *Attorney, Agent, or Firm* — Daniel S. Polley, P.A.

(57) ABSTRACT

A method for monitoring an individual in a dwelling so as to know when such individual falls or indicates the need of assistance. A plurality of 3D motion and sound sensors are located in the dwelling and provide data to a computerized monitoring system. The sensors are configured to recognize one or more biometric identifiers of the individual being monitored. When the monitoring system detects that the individual has fallen or gestured, a computerized communication system contacts the individual to determine the need to send assistance to help the individual. Where assistance is required the system automatics contacts the previously designated caregiver for the individual and can also contact emergency personnel.

19 Claims, 1 Drawing Sheet

(56) References Cited

OTHER PUBLICATIONS

Pending U.S. Application by same inventor Neal Kusens, U.S. Appl. No. 14/611,363, filed Feb. 2, 2015, entitled "Method and System for Determining Whether an Individual Takes Appropriate Measures to Prevent the Spread of Healthcare Associated Infections".

Pending U.S. Application by same inventor Neal Kusens, U.S. Appl. No. 14/613,856, filed Feb. 4, 2015, entitled "Method and System for Determining Whether an Individual Takes Appropriate Measures to Prevent the Spread of Healthcare Associated Infections Along With Centralized Monitoring".

Pending U.S. Application by same inventor Neal Kusens, U.S. Appl. No. 14/623,349, filed Feb. 16, 2015, entitled "Method for Determining Whether an Individual Enters a Prescribed Virtual Zone Using 3D Blob Detection".

* cited by examiner

Diagnosis Determination
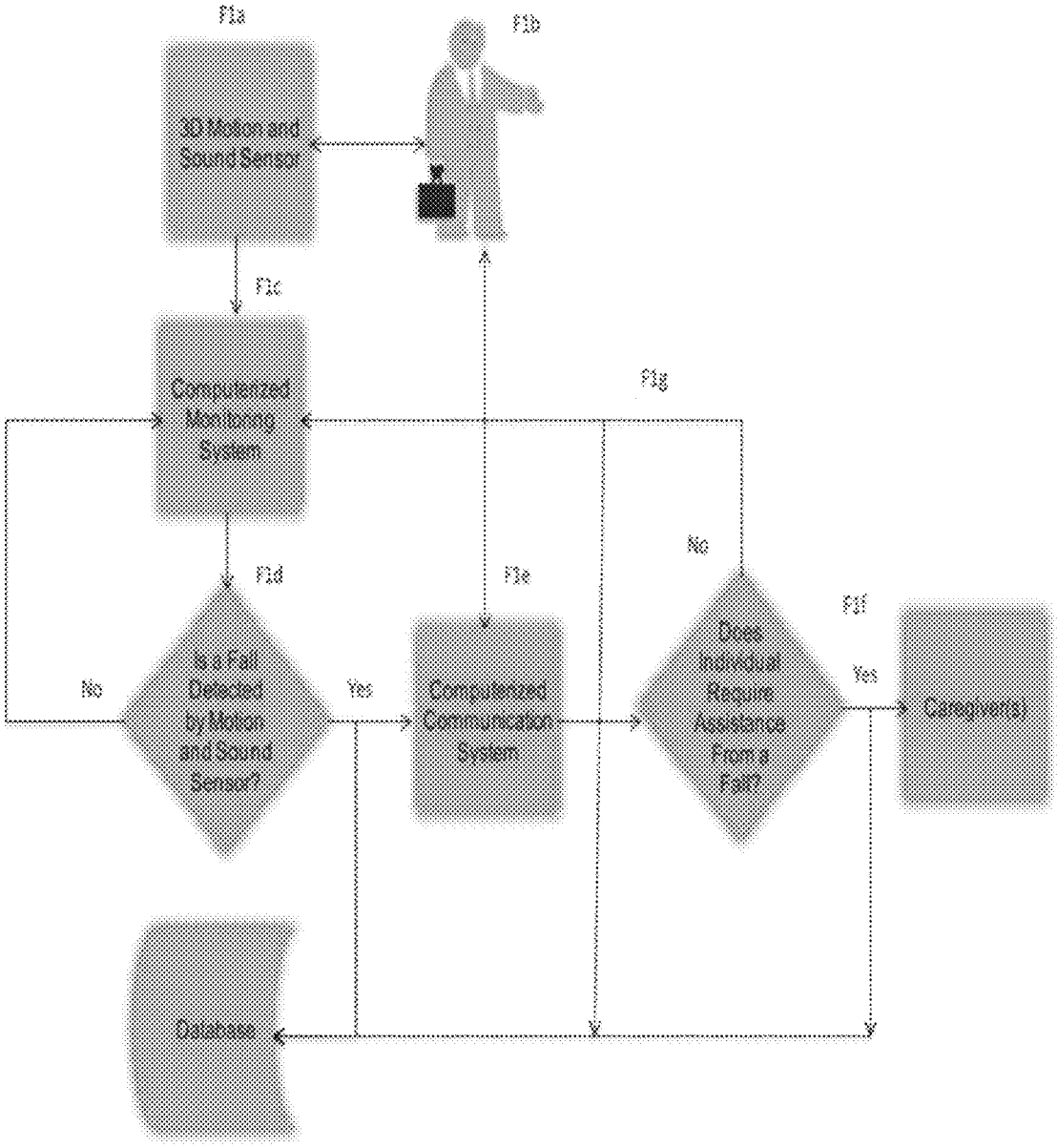

METHOD AND PROCESS FOR DETERMINING WHETHER AN INDIVIDUAL SUFFERS A FALL REQUIRING ASSISTANCE

This application claims the benefit of and priority to U.S. Provisional Patent Application Ser. No. 61/507,088, filed Jul. 12, 2011, which is incorporated by reference in its entirety.

1. FIELD OF THE INVENTION

The present invention relates generally to monitoring systems and particularly to a preferably home monitoring system to monitor movements by individuals within the home.

2. BACKGROUND OF THE INVENTION

According to recent studies, one out of three adults age 65 and older falls each year with that risk increasing proportionately with age. For adults age 80, one in two will fall each year. These falls are the leading cause of injury related death among those age 65 and older and account for 87% of all fractures for those in this age group. Additionally, for those who fall and are unable to get up on their own, the length of time spent immobile can affect their prognosis. Within 30 to 60 minutes of the fall, compression causes muscle cells to begin breaking down. Other complications include but are not limited to dehydration, pressure sores, hypothermia and pneumonia. Even if the fall does not result in injury to the individual, 47% of non-injured fallers cannot get up without assistance. The present invention is directed to overcoming the problem of an undetected fall by an individual, such as, but not limited to an elderly person, who is home alone and unable to get up on their own.

SUMMARY OF THE INVENTION

The present invention generally provides for a method that allows caregivers, central monitoring companies and other persons to monitor disabled, elderly or other high-risk individuals and obtain automatic notification of falls by such an individual where assistance is required.

The following definitions can be used in accordance with the present invention.

| | |
|---|---|
| 3D Motion and Sound Sensor | An electronic device that contains cameras capable of identifying individual objects, people and motion regardless of lighting conditions as well as microphones to detect audio. |
| Computerized Monitoring System | A computer system, which monitors activity of the 3D Motion and Sound sensor. |
| Computerized Communication System | A computer system, which facilitates communication between the patient and computerized monitoring system in the event a fall is detected. |
| System Database | A computer database that stores records of all alerts generated, confirmation requests, responses, and reconfirmation requests. |
| Caregiver | A relative, friend, individual, company or facility whose purpose it to provide assistance in daily living activities for individuals who are disabled, elderly or otherwise in needs of assistance. |

BRIEF DESCRIPTION OF THE DRAWINGS

FIG. 1 is a flowchart of the diagnosis determination made in accordance with one non-limiting embodiment of the present invention.

DETAILED DESCRIPTION OF THE INVENTION

FIG. 1 shows the workflow for monitoring an individual's status through the use of 3D Motion and Sound sensors in accordance with the present invention. At step F1*a* one or more 3D Motion and Sound sensors can be installed in living and rest room areas of the individual's room, home, or other place of residence. The particular rooms in the dwelling that will have sensors and the numbers of sensors that are used are not considered limited to any particular rooms or number of sensors.

At step F1*b* the 3D Motion and Sound sensors can be configured to recognize the individual using biometric identifiers such as height, distance between points on the body, etc.

At step F1*c* data from the 3D Motion and Sound sensors can be sent to a computerized monitoring system. At step F1*d*, if the computerized monitoring system detects a fall based on the movement and alignment of the individual information/data it received from the sensors, it will alert the computerized communication system to confirm the fall with the individual. A record can also be entered in a database to record the incident. If no fall is detected the system will continually monitor the data being sent from the 3D motion and sound sensor. Additionally, the system can also be capable of detecting pre-programmed hand, arm, leg and body gestures or signals to initiate an alert to the computerized communication system. These signals can be used by the monitored individual to alert the system of an emergency or another situation requiring attention, where a fall by the individual has not occurred.

At step F1*e*. The computerized communication system will attempt to contact the individual to verify if a fall occurred and/or whether the patient requires assistance whether by phone call, text messaging, speakerphone, or other electronic means of communication. At step F1*f*, if the individual confirms a fall has occurred and/or the individual requires assistance or fails to respond to the confirmation request in a timely manner, the computerized communication system will notify caregivers or other designated persons (which can also include emergency personnel) that the individual requires assistance. Notification of caregivers can be made through phone call, text messaging, speakerphone systems, email, or other electronic means of communication. The system database can also be updated to reflect actions taken.

At step F1*g*, if the individual responds indicating a false alarm or they are not in need of assistance, the system database can be updated to reflect such. Additionally, the system can continue to monitor and communicate with the individual in the event the individual requires assistance despite the initial confirmation to the contrary. Additional monitoring can continue for a specified period of time from the initial confirmation, until the system has detected the individual has arisen from the fall, or until the individual provides voice, electronic, gesture or other type of reconfirmation to the system. All data can be stored in the system database.

The present invention method preferably uses the following components in connection with the performance of such method:

1. 3D Motion and Sound Sensor
2. Computerized Monitoring System
3. Computerized Communication System The various components can be in electrical and wireless communication with each other.

The automatic detection and confirmation of a falling incident for an individual will provide significant administrative and clinical benefits to caregivers and individuals alike, including, but not limited to, the following public benefits and advantages:

1. Automation of fall detection and notification of caregivers or other designated entities.
2. Reduction in response time for individuals who have fallen and require assistance.
3. Increased survival rate for individuals who have experienced a fall
4. Reduction in costs for hospitalization and medical care related to complications from a fall Any computer/server/electronic database system (collectively "Computer System") capable of being programmed with the specific steps of the present invention can be used and is considered within the scope of the invention. Once programmed such Computer System can preferably be considered a special purpose computer limited to the use of two or more of the above particularly described combination of steps (programmed instructions) performing two or more of the above particularly described combination of functions.

All amounts, component or part locations, configurations, values, percentages, materials, orientations, third party databases, etc. discussed above or shown in the drawings, if any, are merely by way of example and are not considered limiting and other amounts, component or part locations, configurations, values, percentages, materials, orientations, third party databases, etc. can be chosen and used and all are considered within the scope of the invention.

Unless feature(s), part(s), component(s), characteristic(s) or function(s) described in the specification or shown in the drawings for a claim element, claim step or claim term specifically appear in the claim with the claim element, claim step or claim term, then the inventor does not consider such feature(s), part(s), component(s), characteristic(s) or function(s) to be included for the claim element, claim step or claim term in the claim when and if the claim element, claim step or claim term is interpreted or construed. Similarly, with respect to any "means for" elements in the claims, the inventor considers such language to require only the minimal amount of features, components, steps, or parts from the specification to achieve the function of the "means for" language and not all of the features, components, steps or parts describe in the specification that are related to the function of the "means for" language.

While the invention has been described and disclosed in certain terms and has disclosed certain embodiments or modifications, persons skilled in the art who have acquainted themselves with the invention, will appreciate that it is not necessarily limited by such terms, nor to the specific embodiments and modification disclosed herein. Thus, a wide variety of alternatives, suggested by the teachings herein, can be practiced without departing from the spirit of the invention, and rights to such alternatives are particularly reserved and considered within the scope of the invention.

What is claimed is:

1. A method for automatically detecting when a monitored individual within a dwelling has fallen or otherwise indicated that he or she needs medical assistance, said method comprising the steps of:

(a) providing one or more 3D motion and sound sensors within one or more rooms of a dwelling occupied by an individual who is to be monitored;

(b) configuring the one or more sensors to capture data from the one or more rooms, said data including movement and alignment information for the monitored individual whenever the individual moves within the one or more rooms;

(c) capturing the data by the 3D motion and sound sensors concerning the one or more rooms regardless of whether any movements or sounds have occurred in the one or more rooms;

(d) forwarding the data to the computerized monitoring system by the one or more sensors prior to the individual falling or making a gesture corresponding to a pre-programmed gesture recognizable by the computerized monitoring system to allow the computerized monitoring system to continually monitor the data sent by the 3D motion and sound sensors; and (e) receiving a message by the individual from a computerized communication system in communication with the computerized monitoring system to determine whether or not the individual needs assistance when the remote computerized monitoring system detects based on the movement and alignment information contained in the data forwarded from the one or more 3D Motion and Sound sensors that the individual has fallen or gestured that he or she needs assistance.

2. The method for automatically detecting when a monitored individual within a dwelling of claim 1 further comprising the step of updating a database in communication with the computerized monitoring system regarding the detection of a fall or gesture by the individual.

3. The method for automatically detecting when a monitored individual within a dwelling of claim 1 further comprising the step of notifying a previously designated contact by an electronic message of the detected fall by or gesture from the monitored individual after determining that the individual has fallen or gestured in step (d).

4. The method for automatically detecting of claim 1 wherein said individual monitored by one or more biometric identifiers of the individual.

5. The method for automatically detecting of claim 4 wherein said one or more biometric identifiers including distance points on a body of the individual.

6. A method for continually monitoring a designated individual in a dwelling in order to automatically detect when such individual falls or otherwise is in need of medical assistance, said method comprising the steps of:

(a) receiving by a computerized monitoring system data from one or more 3D motion and sound sensors located within a remote dwelling independent of and prior to an individual located in the dwelling falling or making a gesture corresponding to a pre-programmed gesture recognizable by the computerized monitoring system, wherein the data including movement and alignment information for an individual being monitored individual whenever the individual moves within the one or more rooms; wherein the one or more sensors capture and forward data concerning images of the one or more;

(b) continually monitoring data being sent by the computerized monitoring system;

(c) detecting from the movement and alignment information contained in the data received from the one or more 3D Motion and Sound sensors that the individual has fallen or has made a gesture corresponding to a pre-programmed gesture by the computerized monitoring system; and (d) contacting the individual by a computerized communication system to determine whether the individual needs assistance sent to the dwelling after detecting that the individual has fallen or made the gesture.

7. The method for monitoring a designated individual in a dwelling of claim 6 further comprising the step of receiving information from the individual as to whether or not to send assistance to the dwelling.

8. The method for monitoring a designated individual in a dwelling of claim 7 further comprising the step of notifying a previously designated caregiver when the individual indicates that he or she needs assistance.

9. The method for monitoring a designated individual in a dwelling of claim 7 further comprising the step of notifying emergency personnel when the individual indicates that he or she needs assistance.

10. The method for monitoring a designated individual in a dwelling of claim 7 further comprising the step of continuing to monitor the individual for a period of time after the individual indicates he or she does not need assistance to be sent to the dwelling.

11. The method for monitoring a designated individual in a dwelling of claim 6 further comprising the step of updating a database in communication with the computerized monitoring system regarding the detection of a fall or gesture by the individual.

12. The method for continually monitoring of claim 6 wherein the individual is monitored by one or more biometric identifiers of the individual.

13. The method for continually monitoring of claim 12 wherein said one or more biometric identifiers including distance points on a body of the individual.

14. A method for monitoring a designated individual in a dwelling in order to detect when such individual falls or otherwise is in need of medical assistance, said method comprising the steps of:

(a) receiving by a computerized monitoring system data forwarded from one or more 3D motion and sound sensors located within a remote dwelling independent of and prior to an individual located in the dwelling falling or making a gesture corresponding to a pre-programmed gesture recognizable by the remote computerized monitoring system and regardless of whether there is any movement or sound occurring in the dwelling, wherein the data including movement and alignment information for an individual being monitored individual whenever the individual moves within the one or more rooms;

(b) continually monitoring data being sent by the computerized monitoring system;

(c) detecting from the movement and alignment information contained in the data received from the one or more 3D motion and sound sensors that the individual has fallen or has made a gesture corresponding to a pre-programmed gesture by the computerized monitoring system;

(d) contacting the individual by a computerized communication system to determine whether the individual needs assistance sent to the dwelling after detecting that the individual has fallen or made the gesture;

(e) receiving information from the individual as to whether or not to send assistance to the dwelling; and (f) notifying a previously designated caregiver when the individual indicates that he or she needs assistance in step (e).

15. The method for monitoring a designated individual in a dwelling of claim 14 further comprising the step of notifying emergency personnel when the individual indicates that he or she needs assistance.

16. The method for monitoring a designated individual in a dwelling of claim 14 further comprising the step of updating a database in communication with the computerized monitoring system regarding the detection of a fall or gesture by the individual.

17. The method for monitoring a designated individual in a dwelling of claim 14 further comprising the step of continuing to monitor the individual for a period of time after the individual indicates he or she does not need assistance to be sent to the dwelling.

18. The method for continually monitoring of claim 14 wherein the individual is monitored by one or more biometric identifiers of the individual.

19. The method for continually monitoring of claim 18 wherein said one or more biometric identifiers including distance points on a body of the individual.

* * * * *

UNITED STATES PATENT AND TRADEMARK OFFICE

CERTIFICATE OF CORRECTION

PATENT NO. : 9,129,506 B1
APPLICATION NO. : 13/543816
DATED : September 8, 2015
INVENTOR(S) : Neil Kusens It is certified that error appears in the above-identified patent and that said Letters Patent is hereby corrected as shown below:

In the Claims

Claim 6, Step (a), Column 4, lines 50-51,
Replace “one or more rooms” with --dwelling--.

Claim 6, Step (a), Column 4, line 52,
Replace “one or more” with --dwelling--.

Signed and Sealed this
Nineteenth Day of January, 2016

Michelle K. Lee

Michelle K. Lee
*Director of the United States Patent and Trademark Office*